US009157194B2

(12) United States Patent
Theurer et al.

(10) Patent No.: US 9,157,194 B2
(45) Date of Patent: Oct. 13, 2015

(54) MACHINE FOR CLEANING A BALLAST BED OF A TRACK

(75) Inventors: Josef Theurer, Vienna (AT); Herbert Woergoetter, Gallneukirchen (AT)

(73) Assignee: Plasser & Theurer, Export von Bahnbaumaschinen, Gesellschaft m.b.H., Vienna (AT)

( * ) Notice: Subject to any disclaimer, the term of this patent is extended or adjusted under 35 U.S.C. 154(b) by 124 days.

(21) Appl. No.: 13/883,608

(22) PCT Filed: Oct. 28, 2011

(86) PCT No.: PCT/EP2011/005466

§ 371 (c)(1), (2), (4) Date: May 6, 2013

(87) PCT Pub. No.: WO2012/069127

PCT Pub. Date: May 31, 2012

(65) Prior Publication Data

US 2013/0228091 A1 Sep. 5, 2013

(30) Foreign Application Priority Data

Nov. 25, 2010 (AT) ..... 1959/2010

(51) Int. Cl.
*E01B 29/04* (2006.01)
*E01B 27/10* (2006.01)

(52) U.S. Cl.
CPC ..... *E01B 27/105* (2013.01)

(58) Field of Classification Search
CPC ..... E01B 27/00; E01B 27/02; E01B 27/021; E01B 27/06; E01B 27/11; E01B 29/00; E01B 33/00
USPC ..... 104/2–5, 7.1–7.3, 8
See application file for complete search history.

(56) References Cited

U.S. PATENT DOCUMENTS

| | | | | |
|---|---|---|---|---|
| 4,640,364 | A * | 2/1987 | Theurer | 171/16 |
| 5,479,725 | A * | 1/1996 | Theurer et al. | 37/104 |
| 6,637,133 | B2 * | 10/2003 | Theurer et al. | 37/104 |

FOREIGN PATENT DOCUMENTS

| | | | |
|---|---|---|---|
| CH | 528 634 | A | 9/1972 |
| DE | 2 226 612 | A1 | 1/1973 |
| EP | 0 152 643 | | 8/1985 |
| EP | 0 512 075 | | 11/1992 |
| FR | 1 242 520 | | 9/1960 |
| GB | 903 242 | A | 8/1962 |

OTHER PUBLICATIONS

International Search Report of PCT/EP2011/005466, Jan. 23, 2013.

* cited by examiner

*Primary Examiner* — R. J. McCarry, Jr.
(74) *Attorney, Agent, or Firm* — Collard & Roe, P.C.

(57) ABSTRACT

In a first method step for cleaning a ballast bed (8) of a track (9), the ballast (6) picked up from a bedding section (7) adjoining sleepers ends (30), after having been cleaned, is introduced underneath the track (9) immediately after the removal—carried out in a second method step—of the ballast (6) located underneath the sleepers.

6 Claims, 2 Drawing Sheets

MACHINE FOR CLEANING A BALLAST BED OF A TRACK

CROSS REFERENCE TO RELATED APPLICATIONS

Figure 1:
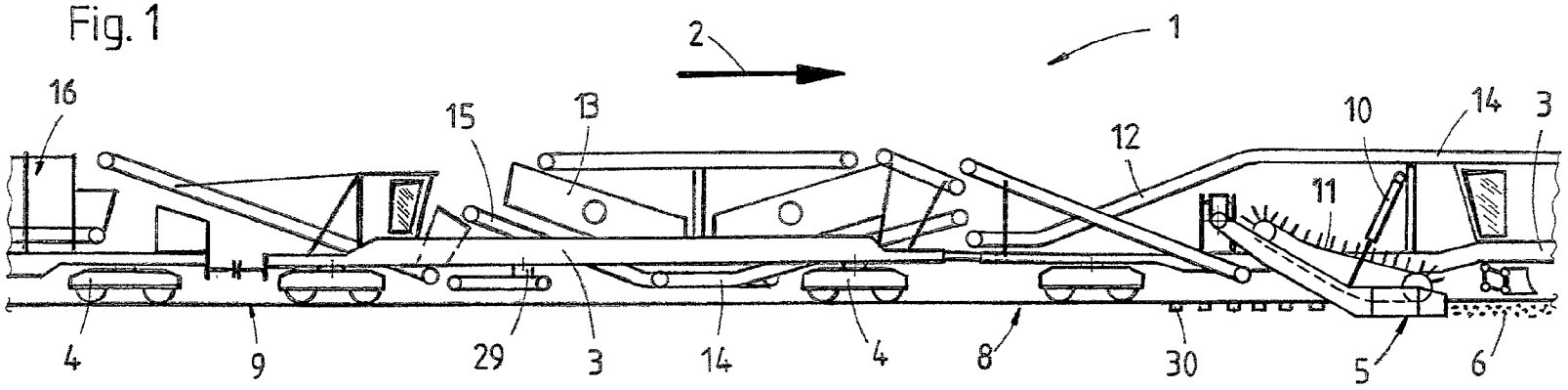

This application is the National Stage of PCT/EP2011/005466 filed on Oct. 28, 2011, which claims priority under 35 U.S.C. §119 of Austrian Application No. A 1959/2010 filed on Nov. 25, 2010, the disclosures of which are incorporated by reference. The international application under PCT article 21(2) was not published in English.

The invention relates to a machine for cleaning a ballast bed of a track.

According to EP 0 512 075, a machine is known with which ballast located in the shoulder region of a ballast bed is picked up with the aid of bucket wheels and cleaned. The ballast present underneath the track is collected by means of an undercutter, delivered to a screening installation for cleaning and finally discharged over the track.

A further machine is known from DE 2 226 612, in which ballast located underneath the track is shifted into the shoulder area by means of an undercutter. In this region of the ballast bed, an endless clearing chain is employed for picking up the ballast shifted laterally by the undercutter and delivering it to a screening installation.

It is the object of the present invention to provide a machine of the type mentioned at the beginning with which it is possible to carry out a simplified cleaning of, in particular, switch sections.

According to the invention, this object is achieved with a machine of the specified type for cleaning a ballast bed of a track.

The cleaning of, in particular, switch sections is simplified with the aid of the invention inasmuch as—as a result of the two-stage picking up of ballast—even the larger quantities of ballast accruing in switch sections can be cleaned in two separate passes. Thus it is possible to employ also a less efficient screening installation. Moreover, a technically difficult transfer of the ballast from the undercutter directly to a device for conveying it upwards is not necessary.

Additional advantages of the invention become apparent from the further claims and the drawing description.

The invention will be described in more detail below with reference to embodiments represented in the drawing.

Figure 2:
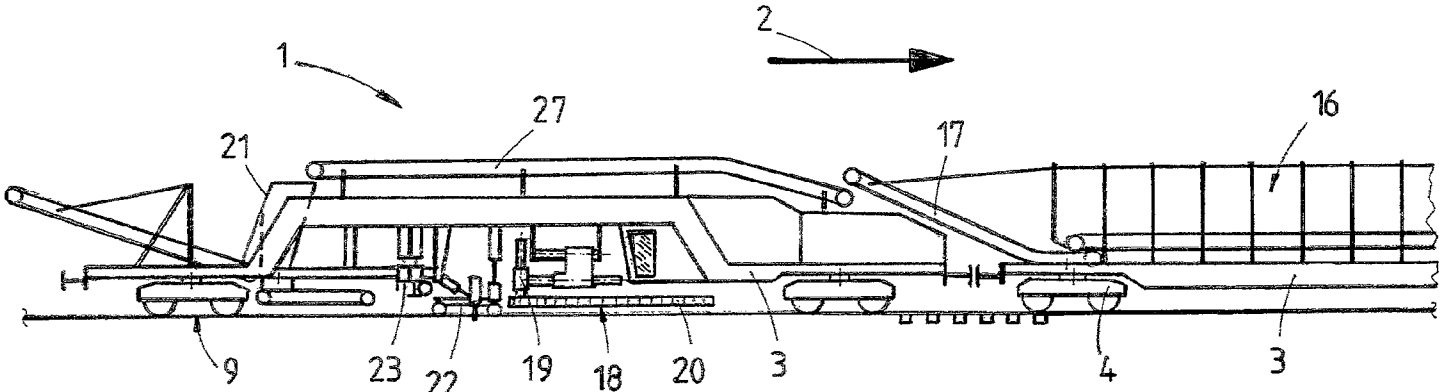
Figure 3:
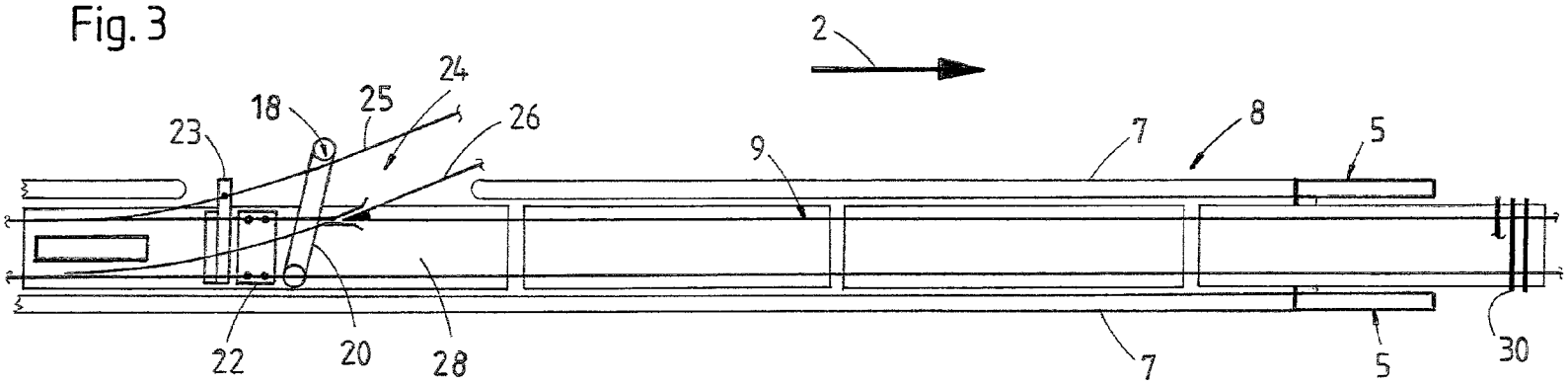
Figure 4:
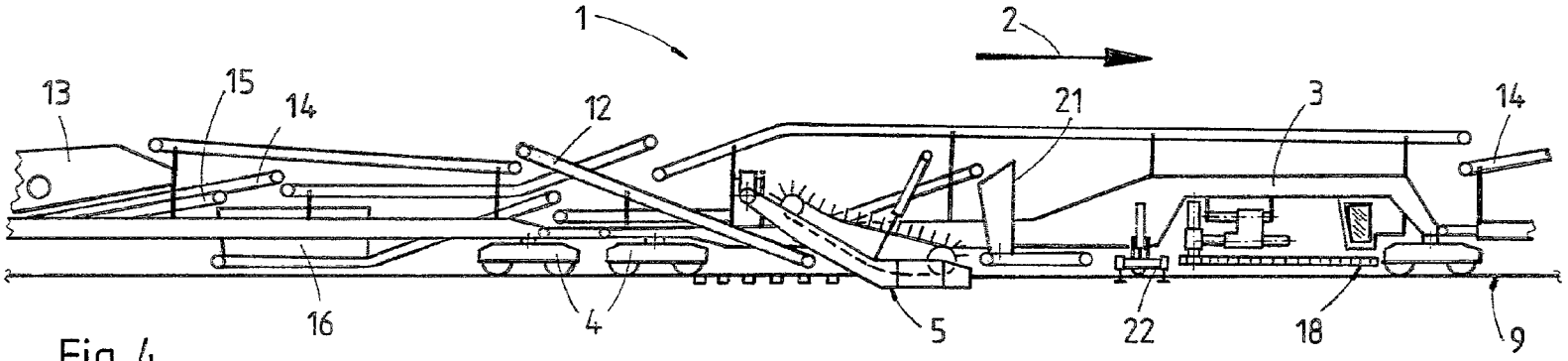

FIGS. 1 and 2 each show a side view of a front or rear part, respectively, of a machine for cleaning ballast, FIG. 3 shows a schematic top view of the said machine, and FIG. 4 shows a further variant of a machine.

A machine 1 shown in FIGS. 1 and 2 is composed of several machine frames 3, arranged one following the other in a working direction 2 and coupled into a train formation, and on-track undercarriages 4. Arranged on a front machine frame 3 is a shoulder pick-up device 5 for picking up ballast 6 from a bedding section 7 of a ballast bed 8 of a track 9 (see FIG. 3), the bedding section adjoining sleeper ends 30. The shoulder pick-up device 5 is composed of a conveyor chain 11, vertically adjustable by a drive 10, which is rotatable in a vertical plane extending parallel to the track 9 and is provided for transfer of the picked-up ballast 6 to a conveyor unit 12.

The latter ends above a screening unit 13. Provided below the same is a further conveyor unit 14 for transporting away spoil, as well as a conveyor unit 15 for transporting the cleaned ballast onward into a store 16 for intermediate storage. The latter has a large storage volume and a conveyor unit 17 for self-unloading.

The machine frame 3 adjoining the store 16 is equipped with a so-called undercutter 18 which is formed of a conveyor chain 20 rotatable by means of a drive 19 parallel to a track plane. Said conveyor chain 20 is pivotable from an inoperative position, visible in FIG. 2, into a working position under the track 9, indicated in FIG. 3. Provided immediately behind the undercutter 18, with regard to the working direction 2 of the machine 1, is a device 21 in the shape of a chute for discharging the cleaned ballast 6 onto the track 9, as well as a track lifting device 22.

Provided in addition to the track lifting device 22 is an auxiliary lifting device 23, arranged immediately behind the undercutter 18, for lifting a rail 25—provided in a switch section 24 (see FIG. 3)—of a branch track 26. The device 21 for discharging the cleaned ballast 6 is connected to the store 16 by means of a further conveyor unit 27.

The method for cleaning the ballast bed 8 in a switch section 24 will now be described in more detail with reference to FIGS. 1 to 3. In the course of a first machine advance and a first method step, the ballast 6 present in the said bedding section 7, now deepened, is picked up with the aid of the shoulder pick-up device 5 and cleaned. Parallel to that—rearward with regard to the working direction 2—in a second method step, the ballast 6 located underneath the track 9 is shifted into the said bedding section 7. This is achieved by using the undercutter 18 which has been pivoted inward underneath the track. In this, it is advantageous that—due to the previous excavation of ballast—the shifting of the ballast present underneath the track 9 into the bedding section 7 adjoining the sleeper ends 30 is facilitated.

During work in the switch section 24, both rails of a main track 28 as well as one rail 25 of the branch track 26 are gripped in order to achieve an adequate fixation of the switch.

After cleaning, the ballast 6 picked up by the shoulder pick-up device 5 is intermediately stored in the store 16 to the extent required in each case and discharged via the device 21 upon the track 9 immediately after operation of the undercutter 18. Thus, the ballast bed situated underneath the track 9 is rapidly restored.

After the end of the switch section 24 (up to which the length of the undercutter 18 is still sufficient) has been reached, the shoulder pick-up device 5 and the undercutter 18 are transferred into an inoperative position. Subsequently, the machine 1 is moved back to the beginning of the switch section 24.

During the subsequent second machine advance, the undercutter 18 remains in the inoperative position. The ballast 6 shifted before—in the second method step—into the bedding section 7 by the undercutter 18 is now, in a third method step, picked up with the aid of the shoulder pick-up device 5, cleaned, and discharged again into the bedding section 7 via a chute 29.

The cleaning of a switch section 24 with this method is advantageous inasmuch as it is possible in each case by slightly pivoting the undercutter 18 about a vertical pivot axis to quickly and easily adapt to the continuously changing width of the switch. Likewise, the shoulder pick-up device 5 can be adapted without problems to the course of the switch. This can be carried out without interrupting the machine advance. Using the method according to the invention, it is naturally also possible to clean a switch-free track section within the scope of the method steps described.

As can be seen in FIG. 3, it is expedient to use two shoulder pick-up devices 5 in parallel. Within the scope of the invention, it is naturally also possible to use two undercutters 18 which are pivoted inwards in each case from one longitudinal side of the track in the direction towards the track center. In doing so, about half of the ballast situated under the track is shifted into the adjoining bedding section 7 in each case.

In a variant of a machine 1 visible in FIG. 4, a structural modification is provided essentially only in that the undercutter 18, the track lifting unit 22 and the device 21 for introducing ballast are arranged preceding the shoulder pick-up unit 5 in the working direction 2. If needed, the machine 1 can also contain a storage wagon filled with new ballast in order to introduce new ballast as required.

Within the scope of a further variant of the method, it is also possible—instead of cleaning the ballast removed underneath the switch with the aid of the undercutter 18—to merely grade it in the said bedding section 7. Thereafter, new ballast is discharged upon the graded old ballast for complete restoration of the bedding section 7.

The invention claimed is:

1. A machine for cleaning a ballast bed (8) of a track comprising:

a shoulder pick-up device for picking up ballast located in a bedding section adjoining sleepers ends, a separate undercutter comprising an endless conveyor chain rotatable parallel to a track plane—for shifting the ballast located underneath the track into the said bedding section, wherein a device for discharging cleaned ballast upon the track as well as a track lifting unit are provided immediately following the undercutter with regard to a working direction of the machine.

2. The machine according to claim 1, wherein, in addition to the track lifting device, an auxiliary lifting device arranged immediately behind the undercutter is provided for lifting a rail, provided in a switch section, of a branch track.

3. The machine according to claim 1, wherein the device for discharging cleaned ballast is connected by means of a conveyor unit to a store for intermediate storage of the cleaned ballast.

4. The machine as in claim 1, wherein said endless conveyor chain of said separate undercutter is rotatable parallel to a longitudinal extension of the track plane.

5. A method for cleaning a ballast bed (8) of a track (9) with a machine according to claim 1, comprising the following steps:

providing a first machine advance—wherein the ballast located in the said bedding section is picked up with the aid of the shoulder pick-up device, and parallel to that, rearward with regard to a working direction, the ballast located underneath the track is shifted into said bedding section with the aid of the undercutter, providing a subsequent second machine advance—wherein the ballast shifted into the bedding section by the undercutter is picked up with the aid of the shoulder pick-up device, cleaned, and discharged again into the bedding section.

6. The machine as in claim 5, further comprising the step of rotating said endless conveyor chain in a direction parallel to a longitudinal extension of the track plane.

* * * * *